US009883747B2

(12) United States Patent
D'amato et al.

(10) Patent No.: US 9,883,747 B2
(45) **Date of Patent: *Feb. 6, 2018**

(54) FURNITURE COVER ASSEMBLY

(71) Applicant: Classic Accessories, Inc., Kent, WA (US)

(72) Inventors: Charles D'amato, Kent, WA (US); Delina Wells, Kent, WA (US)

(73) Assignee: Classic Accessories, LLC, Kent, WA (US)

( * ) Notice: Subject to any disclaimer, the term of this patent is extended or adjusted under 35 U.S.C. 154(b) by 238 days.

This patent is subject to a terminal disclaimer.

(21) Appl. No.: 14/880,115

(22) Filed: Oct. 9, 2015

(65) Prior Publication Data

US 2016/0120324 A1 May 5, 2016

Related U.S. Application Data

(63) Continuation of application No. 13/888,207, filed on May 6, 2013, now Pat. No. 9,155,397.

(51) Int. Cl.

| | |
|---|---|
| ***B65D 65/22*** | (2006.01) |
| ***A47C 7/66*** | (2006.01) |
| ***A47C 31/11*** | (2006.01) |
| ***A44B 11/25*** | (2006.01) |

(Continued)

(52) U.S. Cl.

CPC ..... *A47C 7/66* (2013.01); *A44B 11/25* (2013.01); *A47B 97/00* (2013.01); *A47C 31/113* (2013.01); *A47G 11/004* (2013.01); *B65D 65/22* (2013.01)

(58) Field of Classification Search

CPC ..... A47C 7/66; A47C 31/113; B60J 11/00; B60J 11/02; B60J 11/06; B65D 65/22

See application file for complete search history.

(56) References Cited

U.S. PATENT DOCUMENTS 2,646,097 A * 7/1953 Gaverth ..... B60J 11/02 135/115

2,950,749 A * 8/1960 MacDonald ..... B60J 11/00 150/166

(Continued)

FOREIGN PATENT DOCUMENTS

JP 08169241 A * 7/1996

*Primary Examiner* — Tri Mai

(74) *Attorney, Agent, or Firm* — Perkins Coie LLP

(57) ABSTRACT

A furniture cover assembly comprising side portions interconnected to define an interior area, wherein at least one side portion has an edge portion adjacent to an access opening to the interior area. The edge portion has a belt tunnel with opposing first and second open ends. An adjustment member is adjacent to the first open end, and a belt is slideably disposed in the belt tunnel. The belt has first and second free end portions projecting from and exterior of the belt tunnel. The belt's first free end portion is adjustably connected to the adjustment member and forms a first adjustable loop exterior of the belt tunnel and is configured to connect to a support structure of a furniture unit when positioned in the interior area. The belt's second free end portion forms a second loop exterior of the belt tunnel adjacent to the second open end and is configured to connect to a second support structure of the furniture unit with the belt tunnel extending between the first and second support structures.

20 Claims, 5 Drawing Sheets

(51) Int. Cl.
*A47B 97/00* (2006.01)
*A47G 11/00* (2006.01)

(56) References Cited

U.S. PATENT DOCUMENTS 4,827,997 A * 5/1989 Rolan ..... B32B 27/12 150/166
4,948,191 A * 8/1990 Cao ..... B60J 11/00 160/370.21
4,964,667 A * 10/1990 Reis ..... B60J 11/08 296/136.02
5,029,933 A * 7/1991 Gillem ..... B60J 11/00 150/166
5,409,286 A * 4/1995 Huang ..... B60J 11/00 150/166
5,452,973 A * 9/1995 Arvin ..... B60P 7/0876 410/117
5,476,127 A * 12/1995 Fournier ..... B60J 11/00 150/166
5,538,169 A * 7/1996 Moore ..... A45C 15/00 190/109
5,620,040 A * 4/1997 Swanner ..... B60J 7/10 160/264
5,632,223 A * 5/1997 Bray ..... B63B 17/02 114/361
5,845,958 A * 12/1998 Rudys ..... B60J 11/00 150/166
6,003,929 A * 12/1999 Birdsell ..... B60P 7/0876 150/166
7,093,878 B1 * 8/2006 Fontanilla ..... B60J 11/025 296/136.07
7,159,631 B2 * 1/2007 Yang ..... B60J 11/00 135/88.05
7,716,878 B1 * 5/2010 Altman ..... E04H 13/003 40/124.5
9,155,397 B2 * 10/2015 D'Amato ..... A47C 7/66
2009/0288980 A1 * 11/2009 Hadala ..... B65D 71/0096 206/597
2010/0025441 A1 * 2/2010 Blaney ..... A45F 5/02 224/148.6

* cited by examiner

FURNITURE COVER ASSEMBLY

CROSS-REFERENCE TO RELATED APPLICATIONS

This application is a continuation of U.S. patent application Ser. No. 13/888,207, filed May 6, 2013, which is incorporated herein by reference in its entirety.

TECHNICAL FIELD

Embodiments of the present invention are directed to furniture covers, including furniture covers for patio furniture.

BACKGROUND

Patio furniture and other outdoor furniture are very popular. Owners often cover the patio furniture with removable covers to protect the furniture from rain, wind, water, dust, debris, or other adverse elements. Conventional furniture covers, however, do not adequately stay on the furniture, particularly in windy or other stormy conditions. Many conventional furniture covers rely on gravity to hold the covers in place. Other furniture covers use elastic bands at their base to snugly engage the furniture. Other furniture covers use line or other constriction devices to decrease the size of the opening of the furniture cover to better fit the furniture. These prior art designs, however, can be unsightly and difficult to install or remove. Accordingly, there is a need for an improved furniture cover that maintains a positive aesthetic appearance while increasing the ease and usability of the cover, allowing the cover to securely connect to the furniture, and ensuring that the cover will remain in position in all kinds of environments and conditions.

SUMMARY

The present invention provides furniture cover assemblies that overcome drawbacks in the prior art and provide additional benefits. A brief summary of some embodiments and aspects of the invention are presented. Thereafter, a detailed description of the illustrated embodiments is presented, which will permit one skilled in the relevant art to understand, make, and use embodiments of the invention. One skilled in the art can obtain a full appreciation of aspects of the invention from the subsequent detailed description, read together with the figures, and from the claims, which follow the detailed description.

In accordance with at least one embodiment of the disclosed technology, a furniture cover assembly comprises a top cover portion and a plurality of side portions interconnected to define an interior area and an access opening to the interior area. At least one side portion has an edge portion adjacent to the access opening, and the edge portion has a belt tunnel with opposing first and second open end portions. A buckle is adjacent to the first open end portion. A belt is disposed in the belt tunnel, and the belt has an intermediate portion axially moveable within the belt tunnel. The belt has first and second free end portions projecting from and positioned exterior of the belt tunnel. The first free end portion of the belt is adjustably connected to the buckle and forms a first adjustable loop exterior of the belt tunnel. The first adjustable loop is configured to connect to a first one of the support structures of the furniture unit. The second free end portion of the belt is connected to the side portion and forms a second adjustable loop exterior of the belt tunnel adjacent to the second open end portion. The second adjustable loop is configured to connect to a second support structure, wherein the belt tunnel extends between the first and second support structures. The intermediate portion of the belt has a length, and the belt is adjustably connected to the buckle to adjust the length of the intermediate portion that extends between the buckle and the second open end portion.

In at least one embodiment, the edge portion of the furniture cover assembly is a first edge portion. The assembly has a second side portion spaced apart from the first side portion, and that has a second edge portion adjacent to the access opening. The second edge portion has a second belt tunnel with opposing third and fourth open ends and a second closed intermediate portion between the third and fourth open ends. A second buckle is attached to the second side portion adjacent to the third open end of the second belt tunnel. A second belt is disposed in the second belt tunnel. The second belt has a second intermediate portion axially moveable within the second belt tunnel and has third and fourth free end portions projecting from and exterior of the second belt tunnel. The third free end portion of the second belt is adjustably connected to the second buckle and forms a third adjustable loop exterior of the second belt tunnel and configured to connect to a third one of the support structures.

Another embodiment of the present technology provides a furniture cover assembly having interconnected side portions that define an interior area. At least one side portion has an edge portion adjacent to an access opening to the interior area. The edge portion has a belt tunnel with opposing first and second open ends. An adjustment member is adjacent to the first open end. A belt is slideably disposed in the belt tunnel and has first and second free end portions projecting from and exterior of the belt tunnel. The first free end portion of the belt is adjustably connected to the adjustment member and forms an adjustable loop exterior of the belt tunnel and configured to connect to a support structure of a furniture unit when positioned in the interior area. The second free end portion of the belt forms a second loop exterior of the belt tunnel adjacent to the second open end and configured to connect to a second support structure of the furniture unit with the belt tunnel extending between the first and second support structures.

Another embodiment of the present technology provides a furniture cover assembly for covering a furniture unit having spaced apart legs or other support structures. The furniture cover assembly comprises a top cover portion and a plurality of side portions that define an interior area and an access opening that provides access into the interior area. At least one side portion has an edge portion adjacent to the access opening, and the edge portion has a belt tunnel with opposing first and second open ends and a closed intermediate portion between the first and second open ends. A first buckle member is attached to the one side portion adjacent to the first open end of the belt tunnel. A second buckle member is attached to the one side portion adjacent to the second open end of the belt tunnel. A belt is slideably disposed in the belt tunnel, and the belt has an intermediate portion axially moveable within the belt tunnel and has first and second free end portions projecting from and exterior of the belt tunnel. The first free end portion of the belt is adjustably connected to the first buckle member and forms a first adjustable loop exterior of the belt tunnel that connects to a first one of the support structures. The second free end portion of the belt is adjustably connected to the second buckle member and forms a second adjustable loop exterior of the belt tunnel configured to connect to a second one of the support structures with the belt tunnel extending between the first and second support structures. The intermediate portion of the belt has a length, and the belt is adjustably connected to the first and second buckle members to adjust the length of the intermediate portion that extends between the first and second buckle portions.

DETAILED DESCRIPTION

Figure 1:
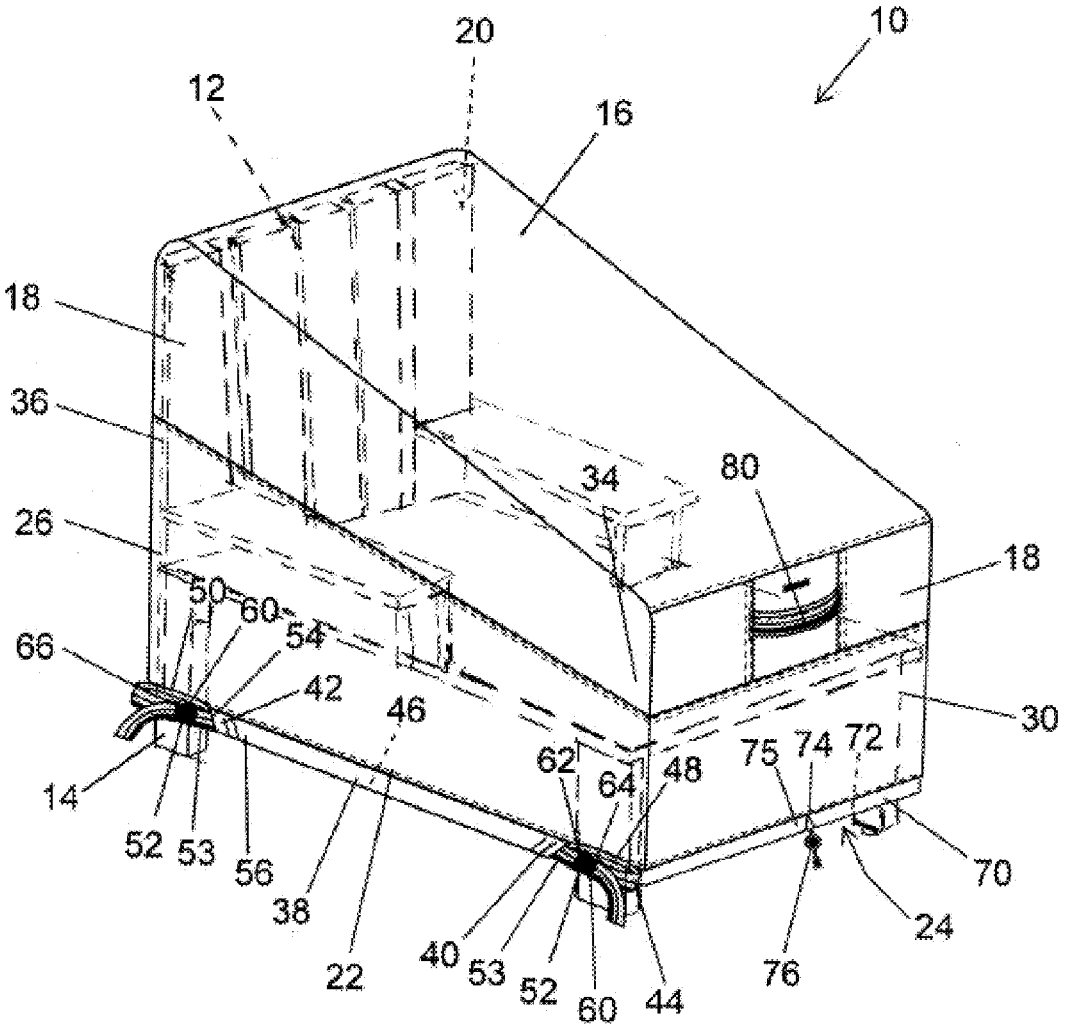
FIG. 1 is a front isometric view of a furniture cover assembly in accordance with at least one embodiment of the present disclosure.

A furniture cover assembly 10 in accordance with one or more embodiments of the present disclosure is shown in the drawings for purposes of illustration. In the following description, numerous specific details are discussed to provide a thorough and enabling description for embodiments of the disclosure. One skilled in the relevant art, however, will recognize that the disclosure can be practiced without one or more of the specific details. In other instances, well-known structures or operations are not shown, or are not described in detail, to avoid obscuring aspects of the disclosure. In general, alternatives and alternate embodiments described herein are substantially similar to the previously described embodiments, and common elements are identified by the same reference numbers.

Figure 2:
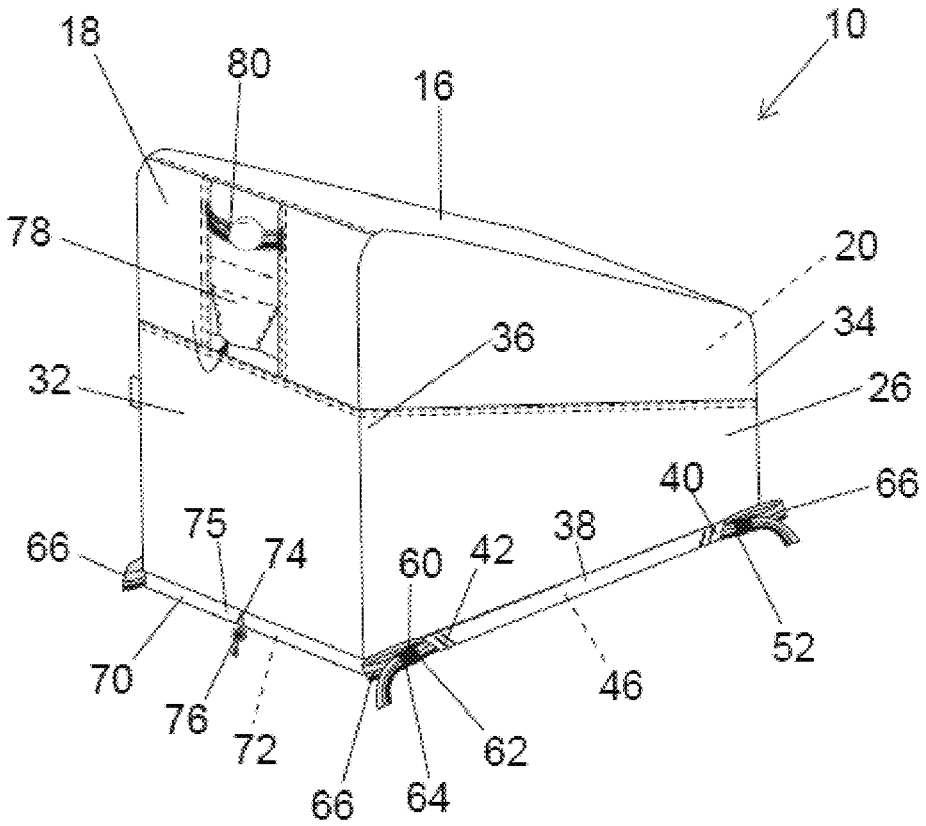
FIG. 2 is a rear isometric view of the furniture cover assembly of FIG. 1.

FIGS. 1 and 2 are front and rear isometric views of the furniture cover assembly 10. The cover assembly 10 of the illustrated embodiment covers and protects a selected piece of furniture 12 (shown schematically in phantom lines) having a plurality of legs 14 or other support structures spaced apart from each other. The illustrated cover assembly 10 has a top panel 16 connected to four side panels 18 that define an interior area 20 within which the furniture 12 fits. The top panel 16 and side panels 18 can all be integrally connected to each other and formed of a continuous material. Alternatively, one or more of the top and side panels 16 and 18 can be separate pieces of material stitched or otherwise joined together. In yet other embodiments, the top panel 16 and/or any of the side panels 18 can be made by a plurality of panel portions stitched or otherwise joined together to form the panel. Each of the side panels 18 have a bottom edge portion 22 spaced away from the top panel 16 and positioned to define an access opening 24 that provides access into the interior area 20. The access opening 24 is shaped and sized to fit over the furniture 12 when the cover assembly 10 is being installed over or removed from the furniture 12.

The illustrated cover assembly 10 has opposing left and right side panels 26 and 28 that span between front and rear side panels 30 and 32. While the illustrated embodiment has four side panels 18, other embodiments can include a different number of side panels that interconnects to the top panel 16 in a configuration to accommodate a variety of different pieces of furniture 12, such as tables, chairs, lounges, benches, cabinets, etc.

The left and right side panels 26 and 28 each have a front edge area 34 that connects to the front side panel 30 and a have rear edge area 36 that connects to the rear side panel 32. The bottom edge portion 22 of each of the left and right side panels 26 and 28 includes a belt tunnel 38 that extends between the front and rear edge areas 34 and 36. Each belt tunnel 38 has open front and rear ends 40 and 42 that provide access into the belt tunnel 38. An elongated belt 44 is slidably disposed within the belt tunnel 38 and positioned so that an intermediate portion 46 of the belt 44 is contained within the belt tunnel 38. Front and rear end portions 48 and 50 of the belt 44 extend through the respective open front and rear ends 40 and 42 and are exterior of the belt tunnel 38. As discussed in greater detail below, the belt's front and rear end portions 48 and 50 extending from the belt tunnel are long enough to create a loop 66 that fits around and secures to a respective leg 14 of the furniture 12. The belt 44 is not permanently fixed to the bottom edge portion 22 of the side panel, such that the belt 44 could be pulled out of the belt tunnel if desired by pulling axially on the free front or rear end portion 48 or 50 of the belt 44.

The cover assembly 10 also has buckle assemblies 52 or other adjustment members attached to the side panels 26 and 28 adjacent to the open ends 40 and 42 of the belt tunnel 38. The buckle assemblies 52 are fixed in a position to releasably and adjustably connect to the respective front or rear end portions 48 or 50 of the belt 44 such that the front and rear end portion 48 and 50 can form the loop 66 that receives the furniture's leg 14. In the illustrated embodiment, the cover assembly 10 has four buckle assemblies 52 adjacent to the front and rear open ends 40 and 42 of the belt tunnels 38 on each of the left and right side panels 26 and 28. Each buckle assembly 52 is substantially identical, so the following description of one buckle assembly is applicable to each of the buckle assemblies of the illustrated embodiment.

Figure 3:
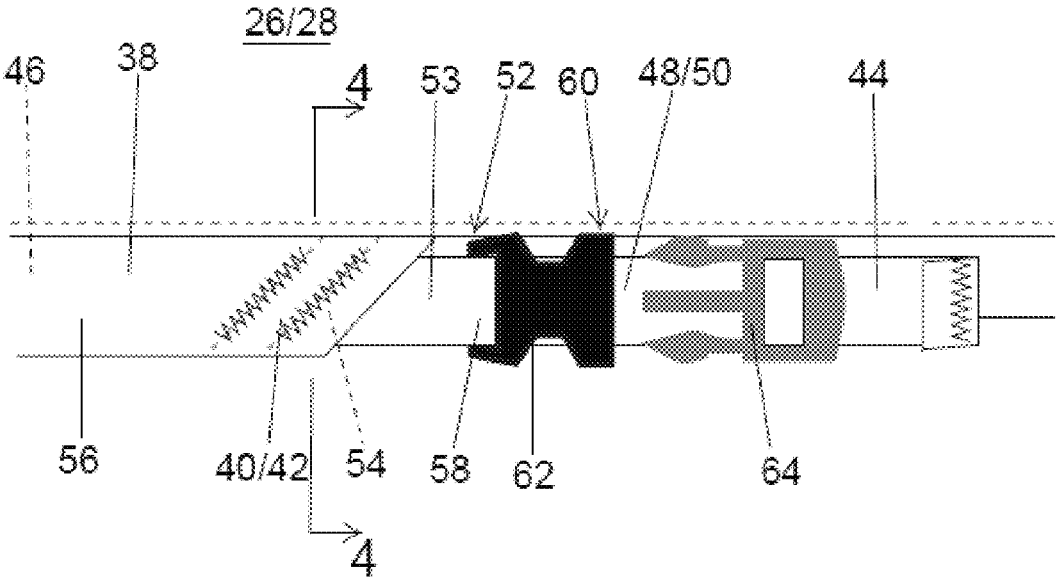
FIG. 3 is an enlarged side elevation view of a strap system of the furniture cover assembly of FIG. 1
Figure 4:
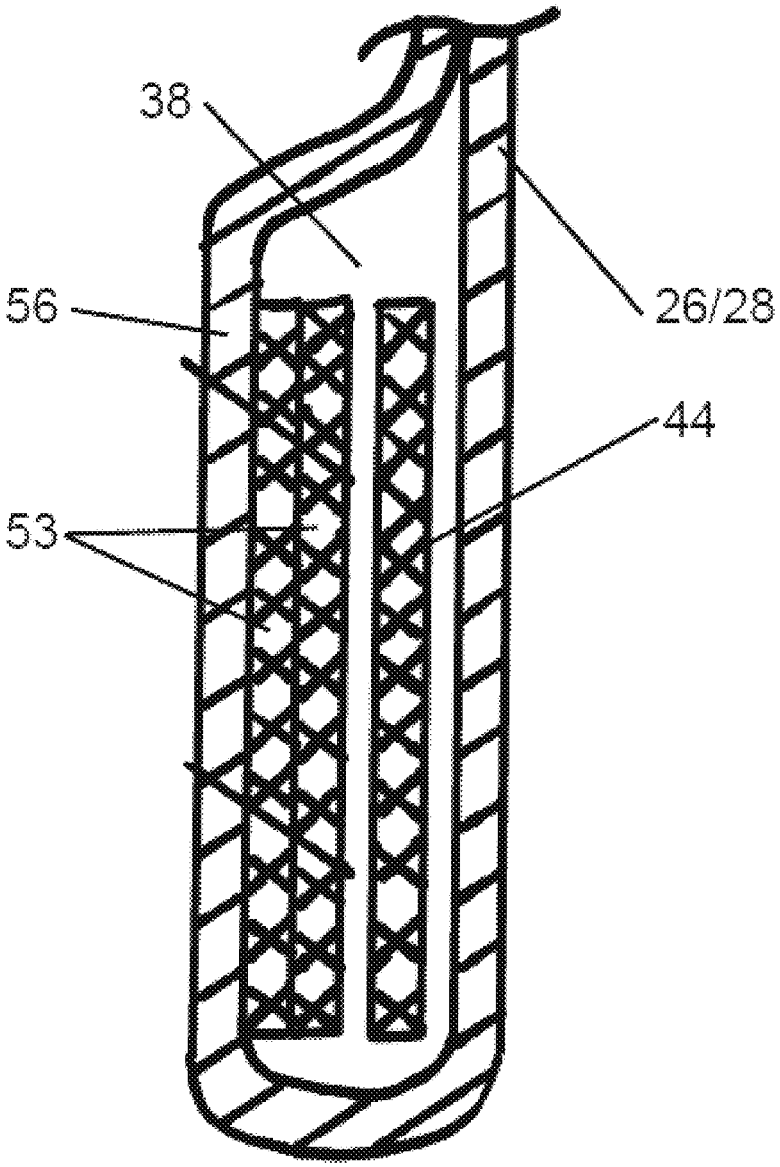
FIG. 4 is a cross-sectional view taken substantially along line 4-4 of the strap system of FIG. 3.

As seen in FIGS. 1, 3 and 4, the buckle assembly 52 has a short web 53 stitched or otherwise securely fixed to the side panel 18 adjacent to the open end 40/42 of the belt tunnel 38. In the illustrated embodiment, one end 54 of the short web 53 is stitched to the outer wall 56 of the belt tunnel 38 immediately adjacent to the tunnel's open end 40/42. In other embodiments, the web 53 can be fixed to the outer wall 56 of the belt tunnel 38, or to the edge portion of the side panel adjacent to the opening of the belt tunnel 38 with other attachment means, such as fasteners, rivets, adhesive, ultrasonic welding, or other sufficiently durable attachment means or mechanisms. The other end 58 of the web 53 is securely attached to a two-piece buckle 60 that has a female buckle portion 62 and a male buckle portion 64 releasably engageable with each other. In the illustrated embodiment, the end 58 of the web 53 is securely fixed to the female buckle portion 62, and the female buckle portion releasably connects to the male buckle portion 64. The illustrated buckle 60 is a conventional side release buckle, although other buckles can be used. In yet other embodiments, the buckle 60 may be a single piece buckle attached to the web 53 and connectable to the front or rear end portion 48 or 50 of the belt 44.

The web 53 of the illustrated embodiment is made of a short length of strap similar to the material that forms the belt 44. The web 53 can be a fabric or other textile material that is flexible and durable so as to withstand the outside elements and normal wear and tear. Other embodiments can use rope, lace, cord, bungee, or other materials for the web 53 and/or the belt 44 that allows for connection to the buckle 60, such as to the side panel 18 adjacent to the opening of the belt tunnel 38. In yet other embodiments, the buckle 60 can be directly affixed to the material forming the belt tunnel 38 or the side panel 18 adjacent to the opening of the belt tunnel.

Figure 5:
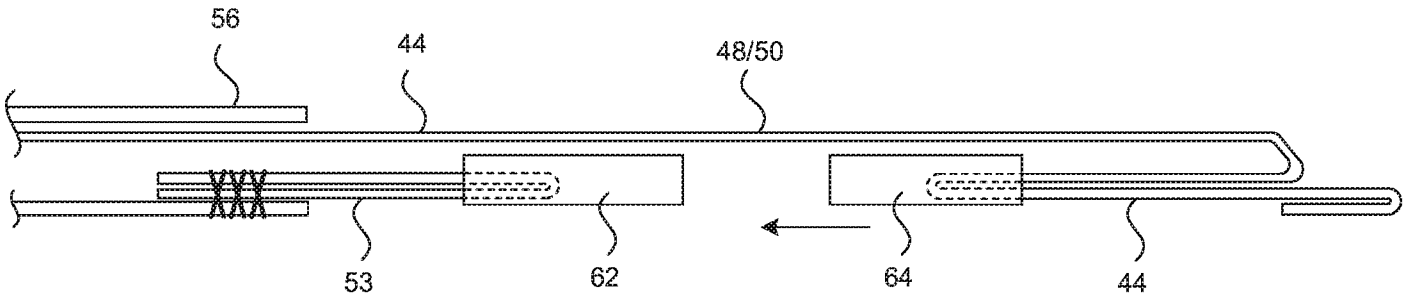
FIG. 5 is a sectional view of the strap system of the furniture cover assembly of FIG. 3.

As best seen in FIGS. 3 and 5, the male buckle portion 64 of the two-piece buckle 60 is threaded onto the front or rear end portion 48 or 50 of the belt 44 and is adjustably positionable along the belt's end portion 48/50. Although the illustrated embodiment shows the female buckle portion 62 attached to the web 53 and the male buckle portion 64 attached to the belt's end portion 48/50, other embodiments can have the male buckle portion 64 attached to the web 53 and the female buckle portion 62 adjustably attached to the belt's end portion 48/50.

Referring again to FIGS. 1 and 2, the belt's end portion 48/50 is connected to the male buckle portion 64 at a position so the end portion has a sufficient length from the belt tunnel's open end 40/42 to form the loop 66 when the male buckle portion 64 is attached to the female buckle portion 62. This loop 66 is configured to extend around and securely engage the furniture's leg 14 slightly above the ground or other supporting surface. The belt's end portion 48/50 can be adjusted to move the male buckle portion 64 along the belt's end portion 48/50 so as to enlarge or reduce the loop 66 as needed to fit around and securely engage the furniture's leg 14 and to retain the associated side panel 18 adjacent to the side of the furniture 12. The loop 66 around the furniture's leg 14 can be easily and quickly opened or closed by disengaging or engaging, respectively, the male and female buckle portions 64 and 62. In addition, when the belt's end portion 48/50 is looped around the leg 14 and the male and female buckle portions 64 and 62 are releasably connected to each other, the belt's end portion 48/50 can be adjusted through the male buckle portion 64 to securely cinch the belt 44 to the furniture's leg 14.

The belt 44 and side panel 18 arrangement of the illustrated embodiment is configured so that, when the cover assembly 10 is positioned over the furniture 12, the front and rear end portions 48 and 50 of the belt 44 are looped around the adjacent legs 14 of the furniture 12, and the male and female buckle portions 64 and 62 attached to each other. The loops 66 formed by the end portions 48/50 of the belt 44 are then tightened through the assemblies 52 so as to effectively shorten the length of the belt 44 extending between the buckle assemblies 52. In this arrangement, the intermediate portion 46 of the belt 44 remains free and slidably disposed within the belt tunnel 38 such that, when the belt 44 has been adjusted/tightened, the side panel 18 adjacent to the belt tunnel 38 is pulled axially between the buckle assemblies 52 and the belt remains taut or under tension between the buckle assemblies 52. The taut belts in the side panels 18 securely hold the side panels down to keep them from excessively flapping in windy conditions. As a result, the side panels remain generally planar with a nice, clean appearance when the cover assembly 10 is installed over the furniture 12.

The cover assembly 10 shown in the illustrated embodiment has the belt tunnels 38, the belts 44, and buckle assemblies 52 on the opposing left and right side panels. The cover assembly 10 in other embodiments can have belt tunnels 38, belts 44 and buckle assemblies 52 on the opposing front and rear side panels 30 and 32, and/or on all of the side panels 18. Other embodiments can include the belt tunnels 38, belts 44 and buckle assemblies 52 on less than all of the side panels 18.

As best seen in FIGS. 1 and 2, the front and rear side panels 30 and 32 each have a channel 70 formed in the panel's bottom edge portion 22 that extends along the length of the panel. Each channel 70 contains a draw member 72, such as a draw string, that exits the channel 70 through an opening 74 in the middle portion 75 of the bottom edge portion 22. In one embodiment, each of the side panels 18 also include a channel for the draw member 72, separate from the belt tunnels, and the draw member extends through the channels about the perimeter of the cover assembly adjacent to the opening 74. In another embodiment, one or more the side panels 18 can include a channel that retains a draw member 72 dedicated to the respective side panel, wherein the draw member 72 is anchored at its ends in or adjacent to the channel 70 in the respective side panel. This allows for individual adjustment of each side panel that includes a draw member 72. In yet another, a draw member 72 can be provided that extends along channels 70 in a pair of adjacent side panels 18. Another embodiment can include a draw member 72 that extends through channels formed in less than all of the side panels. The draw string can be a bungee, an elastic cord, or otherwise stretchable member, or it can be a non-stretchable member. The draw member 72 in other embodiments can be a belt, cable, rope, cord, web, or the like. The draw member 72 is adjustable between tightened positioned to securely hold the cover on the furniture and a loosened position that allows the cover to be placed over or removed from the furniture. In one embodiment, a cord keeper 76 is adjustably attached to the draw member 72 adjacent to the opening 74 and is configured to be positioned along the draw member 72 to tighten the side panels 18 around the furniture 12, or to loosen the side panels 18 relative to the furniture 12 for installation or removal of the cover assembly onto or off of the furniture 12.

As seen in FIG. 2, the cover assembly 10 also includes a vent 78 formed in a side panel 18. The vent 78 in the illustrated embodiment is provided in the rear side panel 32, although other embodiments can include a vent 78 in other side panels 18 or in the top panel 16. The vent 78 allows air to move into and out of the interior area 20, which can facilitate installation or removal of the cover assembly 10 over the furniture 12. The vent 78 can also help reduce flapping of the side panel 18 in windy conditions. The vent 78 can include a cover that allows for airflow through the vent 78 while blocking the passage of rain, water, dust, or debris into the interior area 20 through the vent.

The cover assembly 10 of the illustrated embodiment also includes a handle 80 on the rear side panel 32 adjacent to the vent 78 (FIG. 2) and on the front side panel 30 (FIG. 1) generally adjacent to the top panel 16. Other embodiments can include one or more handles 80 on the left, right, and/or top panels 26, 28, and 16. The handles 80 are configured to allow a user to grasp the handle(s) 80 to facilitate installation or removal of the cover assembly 10 onto or off of the furniture 12.

In operation, the cover assembly 10 is installed over the furniture 12 by disconnecting the buckles 60 or otherwise opening the loops 66 and loosening the cord keeper 76 and draw member 72 to maximize or otherwise enlarge the access opening 24 of the cover assembly 10. The cover assembly 10 is then positioned over the furniture 12 so the furniture is substantially fully within the interior area 20 except for a portion of the legs 14 that extend partially through the access opening 24. The front and rear end portions 48 and 50 of the belt 44 are then wrapped around the associated leg 14 to create the loops 66 around the legs 14. The male and female buckle portions 64 and 62 are then snapped together and the end portions 48/50 of the belts 44 are tightened as needed to securely tighten the belts 44 around the legs 14, while maintaining the bottom edge portion 22 of the side panels 18 substantially in tension (when the distance between the legs 14 is greater than the length of the belt tunnel 38). The draw members 72 on the side panels 18 are then tightened and the cord keeper 76 is adjusted to maintain the draw members 72 in the tight arrangement so as to secure the bottom edge portions 22 of the cover assembly 10 around the bottom perimeter of the furniture 12. The cover assembly 10 can be removed from the furniture 12 by reversing the above process and lifting the cover assembly 10 off of the furniture 12, such as by utilizing the handles 80.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A furniture cover assembly, comprising:

a top cover portion and a plurality of side portions interconnected to define an interior area, at least one side portion having an edge portion with a belt tunnel having opposing first and second open end portions;

a buckle adjacent to the first open end portion; and a belt disposed in the belt tunnel, the belt having an intermediate portion axially moveable within the belt tunnel and having first and second free end portions projecting from and exterior of the belt tunnel, the first free end portion of the belt being adjustably connected to the buckle and forming a first adjustable loop exterior of the belt tunnel, the second free end portion of the belt being connected to the at least one side portion and forming a second adjustable loop exterior of the belt tunnel adjacent to the second open end;

a first attachment web stitched to a portion of the edge portion adjacent to the first open end of the belt tunnel, and the buckle is fixed to the first attachment web; and wherein the intermediate portion of the belt having a length, and the belt being adjustably connected to the buckle to adjust the length of the intermediate portion that extends between the buckle and the second open end portion.

2. The assembly of claim 1, further comprising a draw member attached to an edge portion of one or more of the side panels, wherein the draw member is adjustable between tightened and loosened positions independent of the position of the belt.

3. The assembly of claim 1 wherein one or more of the side panels have a channel therein adjacent to the edge portion and independent of the belt tunnel, and further comprising a draw member disposed in the channel, wherein the draw member is adjustable between tightened and loosened positions independent of the position of the belt.

4. The assembly of claim 1 wherein the buckle is a two-part buckle with first and second buckle portions that releasably connect to each other, wherein the first buckle portion is attached to the edge portion adjacent to the first open end portion of the belt tunnel and the second buckle portion is adjustably attached to the first end portion of the belt.

5. The assembly of claim 1, further comprising a second buckle attached to the one side portion adjacent to the second open end of the belt tunnel, and the second free end portion of the belt is being adjustably connected to the second buckle and forming a second adjustable loop exterior of the belt tunnel.

6. The assembly of claim 5 wherein the second buckle is a two-part buckle with first and second buckle portions that releasably connect to each other, wherein the first buckle portion is attached to the edge portion adjacent to the second open end of the belt tunnel and the second buckle portion is adjustably attached to the second end portion of the belt.

7. The assembly of claim 1, further comprising a second buckle attached to the one side portion adjacent to the second open end of the belt tunnel, and the second free end portion of the belt is adjustably connected to the second buckle and forms a second adjustable loop exterior of the belt tunnel, a second attachment web is attached to the edge portion adjacent to the second open end of the belt tunnel, and the second buckle is fixed to the second attachment web.

8. The assembly of claim 1 wherein the buckle is a two-part buckle with a male buckle portion that releasably connects to a female buckle portion, and one of the male and female buckle portions is adjustably attached to the belt.

9. The assembly of claim 1 wherein the edge portion is a first edge portion, and a second side portion spaced apart from the first side portion has a second edge portion adjacent to the access opening, the second edge portion having a second belt tunnel with opposing third and fourth open ends and a second closed intermediate portion between the third and fourth open ends, and the assembly further comprising:

a second buckle attached to the second side portion adjacent to the third open end of the second belt tunnel; and a second belt disposed in the second belt tunnel, the second belt having a second intermediate portion being axially moveable within the second belt tunnel and having third and fourth free end portions projecting from and exterior of the second belt tunnel, the third free end portion of the second belt being adjustably connected to the second buckle and forms a third adjustable loop exterior of the second belt tunnel and configured to connect to a third one of the support structures.

10. The assembly of claim 9 wherein the fourth free end portion of the second belt being adjustably connected to the third buckle and forming a fourth adjustable loop exterior of the second belt tunnel and configured to connect to a fourth one of the support structures with the second belt tunnel extending between the third and fourth support structures.

11. The assembly of claim 1, further comprising a vent portion connected to one of the side portions or the top portion and configured to allow air flow therethrough into or from the interior area.

12. A cover assembly, comprising:

a top cover portion and a plurality of side portions connected to the top cover portion, the top cover portion and the side portions define an interior area;

at least one side portion having an edge portion adjacent to the access opening, the edge portion having a belt tunnel with opposing first and second open ends and a closed intermediate portion between the first and second open ends;

a first buckle member attached to the one side portion adjacent to the first open end of the belt tunnel;

a second buckle member attached to the one side portion adjacent to the second open end of the belt tunnel; and a belt disposed in the belt tunnel, the belt having an intermediate portion being axially moveable within the belt tunnel and having first and second free end portions projecting from and exterior of the belt tunnel;

the first free end portion of the belt being adjustably connected to the first buckle member and forming a first adjustable loop exterior of the belt tunnel;

the second free end portion of the belt being adjustably connected to the second buckle member and forming a second adjustable loop exterior of the belt tunnel;

a first attachment web stitched to a portion of the edge portion adjacent to the first open end of the belt tunnel, and the first buckle is fixed to the first attachment web;

a first attachment web stitched to a portion of the edge portion adjacent to the first open end of the belt tunnel, and the first buckle is fixed to the first attachment web; and wherein the intermediate portion of the belt having a length, and the belt being adjustably connected to the first and second buckle members to adjust the length of the intermediate portion that extends between the first and second buckle portions.

13. The assembly of claim 12 wherein the first buckle is a two-part buckle with first and second buckle portions that releasably connect to each other, wherein the first buckle portion is attached to the edge portion adjacent to the first open end of the belt tunnel and the second buckle portion is adjustably attached to the first end portion of the belt.

14. The assembly of claim 12 wherein each of the first and second buckles is a two-part buckle with first and second buckle portions that releasably connect to each other, wherein the first buckle portion of the first buckle is attached to the edge portion adjacent to the first open end of the belt tunnel, and the first buckle portion of the second buckle is attached to the edge portion adjacent to the second open end of the belt tunnel.

15. The assembly of claim 12, further comprising a second attachment web stitched to a portion of the edge portion adjacent to the second open end of the belt tunnel, and the second buckle is fixed to the second attachment web.

16. The assembly of claim 12 wherein the edge portion is a first edge portion, and a second side portion spaced apart from the first side portion has a second edge portion adjacent to the access opening, the second edge portion having a second belt tunnel with opposing third and fourth open ends and a second closed intermediate portion between the third and fourth open ends, and the assembly further comprising:

a third buckle attached to the second side portion adjacent to the third open end of the second belt tunnel;

a fourth buckle attached to the second side portion adjacent to the fourth open end of the second belt tunnel; and a second belt disposed in the second belt tunnel, the second belt having a second intermediate portion being axially moveable within the second belt tunnel and having third and fourth free end portions projecting from and exterior of the second belt tunnel;

wherein the third free end portion of the second belt is adjustably connected to the third buckle and forms a third adjustable loop exterior of the second belt tunnel and is configured to connect to a third one of the support structures, and the fourth free end portion of the second belt is adjustably connected to the fourth buckle and forms a fourth adjustable loop exterior of the second belt tunnel and is configured to connect to a fourth one of the support structures with the second belt tunnel extending between the third and fourth support structures.

17. A cover assembly, comprising:

side portions interconnected to define an interior area, at least one side portion having an edge portion with a belt tunnel having opposing first and second open ends, and one or more of the side portions having a draw channel independent of the belt tunnel;

an adjustment member adjacent to the first open end;

a belt slideably disposed in the belt tunnel, the belt having first and second free end portions projecting from and exterior of the belt tunnel, the first free end portion of the belt being adjustably connected to the adjustment member and forming a first adjustable loop exterior of the belt tunnel and configured to connect to a support structure when positioned in the interior area, the second free end portion of the belt forming a second loop exterior of the belt tunnel adjacent to the second open end and configured to connect to a second support structure spaced apart from the first support structure with the belt tunnel extending between the first and second support structures; and a draw member disposed in the draw channel and adjustable between tightened and loosened positions independent of the belt;

wherein the adjustment member is a two-part buckle with first and second buckle portions that releasably connect to each other, wherein the first buckle portion is attached to the edge portion adjacent to the first open end of the belt tunnel and the second buckle portion is adjustably attached to the first end portion of the belt.

18. The assembly of claim 17, further comprising a second adjustment member attached to the one side portion adjacent to the second open end of the belt tunnel; and the second free end portion of the belt is being adjustably connected to the second buckle and forming a second adjustable loop exterior of the belt tunnel.

19. The assembly of claim 17, further comprising a first attachment web stitched to a portion of the edge portion adjacent to the first open end of the belt tunnel, and the adjustment member is fixed to the first attachment web.

20. The assembly of claim 17, further comprising a second adjustment member attached to the one side portion adjacent to the second open end of the belt tunnel, and the second free end portion of the belt is adjustably connected to the second adjustment member and forms a second adjustable loop exterior of the belt tunnel, a second attachment web is attached to the edge portion adjacent to the second open end of the belt tunnel, and the second adjustment member is fixed to the second attachment web.

* * * * *